US007510032B2

(12) United States Patent
Kirk et al.

(10) Patent No.: US 7,510,032 B2
(45) Date of Patent: Mar. 31, 2009

(54) HARD COMPOSITE CUTTING INSERT AND METHOD OF MAKING THE SAME

(75) Inventors: Terry W. Kirk, Fayetteville, AR (US); Brian R. Nussbaum, Houston, TX (US); Jon W. Bitler, Fayetteville, AR (US)

(73) Assignee: Kennametal Inc., Latrobe, PA (US)

( * ) Notice: Subject to any disclaimer, the term of this patent is extended or adjusted under 35 U.S.C. 154(b) by 103 days.

(21) Appl. No.: 11/396,109

(22) Filed: Mar. 31, 2006

(65) Prior Publication Data

US 2007/0227782 A1 Oct. 4, 2007

(51) Int. Cl.
*E21B 10/56* (2006.01)

(52) U.S. Cl. ..... 175/420.1; 175/426; 51/309

(58) Field of Classification Search ..... 175/425, 175/426, 420.1; 51/309; 76/108.1, 108.2, 76/108.4

See application file for complete search history.

(56) References Cited

U.S. PATENT DOCUMENTS

| | | | | |
|---|---|---|---|---|
| 2,842,342 | A | | 7/1958 | Haglund |
| 2,888,247 | A | | 5/1959 | Haglund |
| 2,889,138 | A | | 6/1959 | Haglund |
| 4,106,578 | A | | 8/1978 | Beyer |
| 4,255,165 | A | * | 3/1981 | Dennis et al. ..... 51/309 |
| 4,427,081 | A | | 1/1984 | Crawford |
| 4,452,325 | A | * | 6/1984 | Radd et al. ..... 175/426 |
| 4,705,124 | A | | 11/1987 | Abrahamson et al. |
| 4,722,405 | A | | 2/1988 | Langford, Jr. |
| 4,743,515 | A | * | 5/1988 | Fischer et al. ..... 428/698 |
| 4,797,138 | A | * | 1/1989 | Komanduri ..... 51/295 |
| 4,830,930 | A | * | 5/1989 | Taniguchi et al. ..... 428/547 |
| 5,154,245 | A | * | 10/1992 | Waldenstrom et al. ... 175/420.2 |
| 5,205,684 | A | * | 4/1993 | Meskin et al. ..... 408/145 |
| 5,413,869 | A | * | 5/1995 | Hartzell et al. ..... 428/469 |
| 5,467,669 | A | | 11/1995 | Stroud |
| 5,697,046 | A | * | 12/1997 | Conley ..... 428/547 |
| 5,848,348 | A | * | 12/1998 | Dennis ..... 419/5 |
| 6,004,505 | A | * | 12/1999 | Roy et al. ..... 419/6 |
| 6,500,226 | B1 | * | 12/2002 | Dennis ..... 75/240 |
| 2006/0131081 | A1 | * | 6/2006 | Mirchandani et al. ..... 175/426 |

* cited by examiner

*Primary Examiner*—Kenneth Thompson
(74) *Attorney, Agent, or Firm*—Matthew W. Smith

(57) ABSTRACT

A hard composite cutting insert useful for cutting strata such as earth or rock that includes a body that is tough. The body contains a member that is harder than the body (i.e., has a harder region). The combination of the tough body with the harder member (or region) embedded therein provides a hard composite cutting insert with advantageous properties when used in conjunction with a bit body for impinging upon, and thereby disintegrating, the earth strata.

16 Claims, 8 Drawing Sheets

HARDNESS PROFILE ACROSS THE TRANSVERSE DIMENSION OF EXAMPLE A

HARDNESS PROFILE ACROSS THE TRANSVERSE DIMENSION OF EXAMPLE A

HARDNESS PROFILE ACROSS THE TRANSVERSE DIMENSION OF EXAMPLE B

HARD COMPOSITE CUTTING INSERT AND METHOD OF MAKING THE SAME

BACKGROUND OF THE INVENTION

The present invention pertains to a hard composite cutting insert and a method of making the same. More specifically, the present invention pertains to a hard composite cutting insert that has at least two distinct regions of different material grades, as well as a method of making the cutting insert.

Hard composite cutting inserts, or hard cutting inserts, are used in conjunction with a bit body for impinging upon, and thereby disintegrating, the earth strata. Common applications that disintegrate earth strata via a cutting bit with one or more hard composite cutting inserts include road planning, coal mining and other underground mining activities, and drilling such as in the drilling of oil and gas wells.

In the case of drilling oil and gas wells, drill bits are installed at the lower end of a rotary drill string. The drill bits impinge upon the earth strata (e.g., rock and other hard formations) so as to accomplish the drilling of the bore hole for the well. These drill bits can include a tri-cone rotary drill bit such as is described and disclosed in U.S. Pat. No. 4,427,081 to Crawford. These drill bits may also include a percussion style of drill bit such as shown and described in U.S. Pat. No. 4,106,578 to Beyer. In either one of these types of drill bits, the drill bit head contains one or more apertures wherein each aperture receives its corresponding hard cutting insert. The hard cutting insert protrudes past the surface of the drill bit head to engage or impinge and disintegrate the earth strata.

Generally speaking, the hard cutting inserts are made out of cemented carbide, and more specifically, a cobalt cemented tungsten carbide. While there are a number of parameters that may vary between different grades of cobalt cemented tungsten carbide, two principle parameters are the cobalt (or binder) content and the grain size (or average grain size) of the tungsten carbide particles (i.e., hard particles). The composition of cobalt cemented tungsten carbides can also vary wherein the composition may include additives such as titanium, niobium, tantalum, vanadium, chromium and other Group IV, V or VI metals or the carbides of such metals. By varying the compositional aspects (e.g., cobalt (or binder)) content, hard carbide content, hard carbide particle size and/or the nature and extent of additives, the properties of the cemented carbide can vary. For example, the hard cemented carbide may possess a high hardness but a lower toughness or it may have a low hardness and a higher toughness.

Heretofore, some have used a dual grade hard composite cutting insert that includes two different grades of material (e.g., cobalt cemented tungsten carbide). One exemplary patent that shows a dual grade hard insert is U.S. Pat. No. 5,467,669 to Stroud. Based upon the cross-sectional views presented by FIGS. 3-6 of U.S. Pat. No. 5,467,669, it appears that one grade of material is encapsulated by another (or outer) grade of material. According to U.S. Pat. No. 5,467,669, the outer grade of material is harder and the encapsulated grade of material is tougher.

U.S. Pat. No. 5,467,669 also mentions other patents that are supposed to be dual grade inserts. These patents include U.S. Pat. No. 2,842,342 to Hagland, U.S. Pat. No. 2,888,247 to Hagland, U.S. Pat. No. 2,899,138 to Hagland, U.S. Pat. No. 4,705,124 to Abrahamson et al., and U.S. Pat. No. 4,722,405 to Langford et al.

As can be appreciated, it would be desirable to provide an improved hard composite cutting insert used in conjunction with a bit body for the purpose of impinging the earth strata wherein optimum properties for hardness and toughness can be achieved through the use of multiple grades of hard materials in one hard composite cutting insert.

It would also be desirable to provide an improved hard composite cutting insert used in conjunction with a bit body for the purpose of impinging the earth strata wherein various geometric configurations of different grades of material can be employed by the hard composite cutting insert.

Further, it would be desirable to provide an improved hard composite cutting insert used in conjunction with a bit body for the purpose of impinging the earth strata wherein different regions of different grades of material can be selectively positioned or located in the hard composite cutting insert.

In addition, it would be desirable to provide an improved method to make an improved hard composite cutting insert that achieves any one or more of the above-recited goals, and wherein the method is economical to perform.

SUMMARY OF THE INVENTION

In one form, the invention is a hard composite cutting insert that has a peripheral surface, and comprises a matrix region wherein a portion of the matrix region defines a first section of the peripheral surface. The matrix region contains an embedded region wherein a portion of the embedded region defines a second section of the peripheral surface. The first section of the peripheral surface is greater than the second section of the peripheral surface. The matrix region is made from a first composition and the embedded region is made from a second composition wherein the first composition has a toughness greater than the toughness of the second composition and the second composition has a hardness greater than the hardness of the first composition.

In yet another form thereof, the invention is a hard composite cutting insert for use in conjunction with a drill bit containing a recess wherein the hard composite cutting insert is received within the recess so that a portion of the hard composite cutting insert protrudes from the drill bit. The hard composite cutting insert comprises a cutting insert body that has a top end and a bottom end. When the hard composite cutting insert is received within the recess, a portion of the cutting insert body adjacent to the top end protrudes from the drill bit. A hard member has a top end and a bottom end. The hard member is contained within the cutting insert body so that top end of the hard member is exposed at the top end of the cutting insert body. The cutting insert body is made from a first composition and the hard member is made from a second composition wherein the first composition has a toughness greater than the toughness of the second composition and the second composition has a hardness greater than the hardness of he first composition.

In still another form thereof, the invention is a hard composite cutting insert for use in conjunction with a drill bit containing a recess wherein the hard composite cutting insert is received within the recess so that a portion of the hard composite cutting insert protrudes from the drill bit. The hard composite cutting insert comprises a cutting insert body that has a top end and a bottom end. When the hard composite cutting insert is received within the recess, a portion of the cutting insert body adjacent to the top end protrudes from the drill bit. A hard member has a top end and a bottom end. The hard member is contained within the cutting insert body so that bottom end of the hard member is exposed at the bottom end of the cutting insert body whereby when the hard composite cutting insert is received within the recess, the hard member is not exposed. The cutting insert body is made from a first composition and the hard member is made from a second composition wherein the first composition has a toughness greater than the toughness of the second composition and the second composition has a hardness greater than the hardness of he first composition.

In another form thereof, the invention is a method for making a hard composite cutting insert comprising the steps of: providing a body containing a cavity therein, and the cavity having an opening thereto, and the body being made from a first composition; positioning a sintered hard member in the cavity to form a composite, and the sintered hard member being made from a second composition wherein the first composition having a toughness greater than the toughness of the second composition and the second composition having a hardness greater than the hardness of the first composition; and sintering the composite to form the hard composite cutting insert.

In still another form thereof, the invention is a method for making a hard composite cutting insert comprising the steps of: providing a body containing a cavity therein, and the cavity having an opening thereto, and the body being made from a first composition; positioning a powder mixture of tungsten carbide and cobalt in the cavity to form a composite, and the powder mixture being of a second composition wherein the first composition having a toughness greater than the toughness of the second composition and the second composition having a hardness greater than the hardness of the first composition; and sintering the composite to form the hard composite cutting insert.

BRIEF DESCRIPTION OF THE DRAWINGS

The following is a description of the drawings that form a part of this patent application.

FIG. 14 is a hardness profile across the transverse dimension of a specific Example B (10 weight percent cobalt-medium grain tungsten carbide body with a 10 weight percent cobalt-finer grain tungsten carbide insert) of the hard composite cutting insert and where the hardness profile is illustrated against a background of the profile of the hard insert with the vertical axis representing the hardness (Rockwell A) and the horizontal axis representing the transverse dimension set forth in millimeters; and.

DETAILED DESCRIPTION OF SPECIFIC EMBODIMENTS

Figure 1:
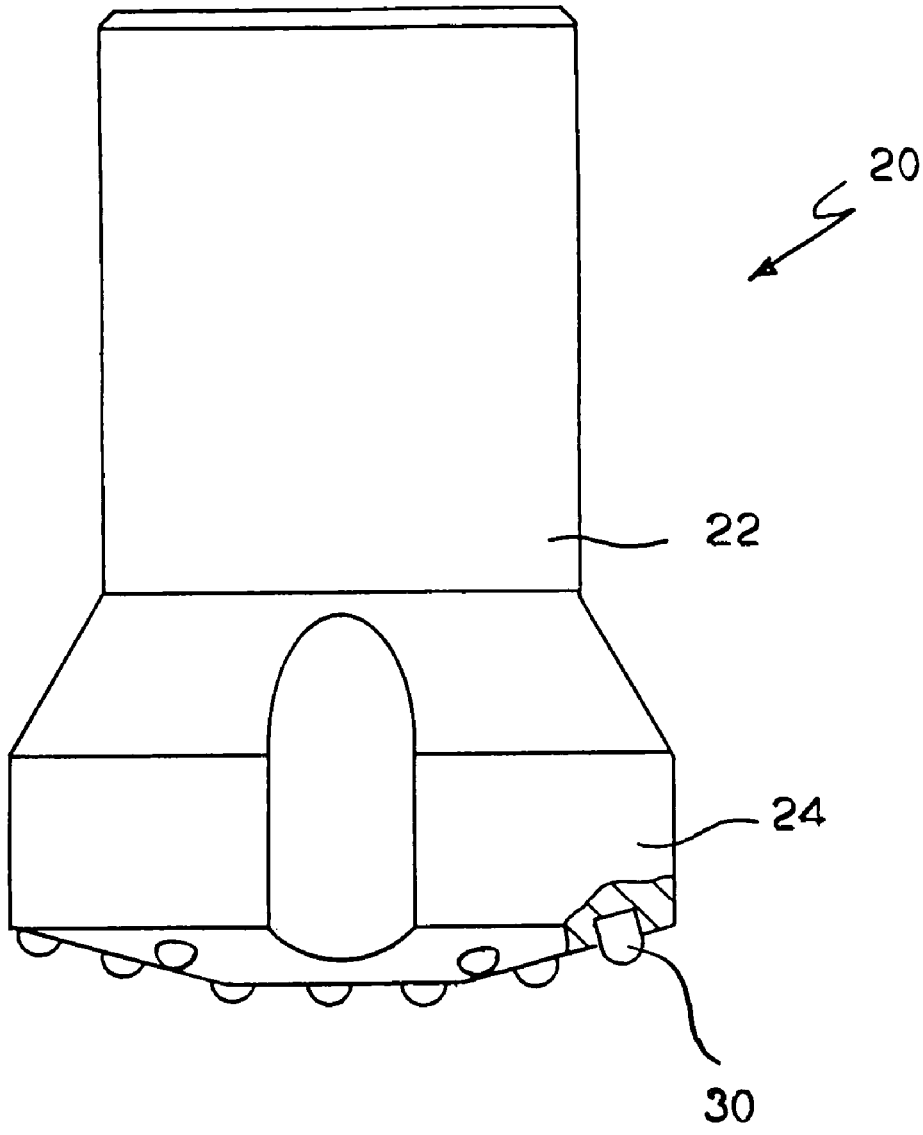
FIG. 1 is a side view of a downhole drill bit used in the drilling for gas and oil and wherein the drill bit uses hard composite cutting inserts of the present invention.

Referring to the drawings, FIG. 1 illustrates a downhole drill bit generally designated as 20. Drill bit 20 is typically used to drill a bore hole in the drilling for oil or gas. Drill bit 20 includes a drill bit body 22 that includes a drill bit head 24 at the bottom head thereof. The drill bit head 24 contains a plurality of hard composite cutting insert 40. The portion of the hard composite cutting insert 40 adjacent to the top end of the insert 40 protrudes past the surface of the drill bit head 24 and engages the earth strata during use.

Figure 2B:
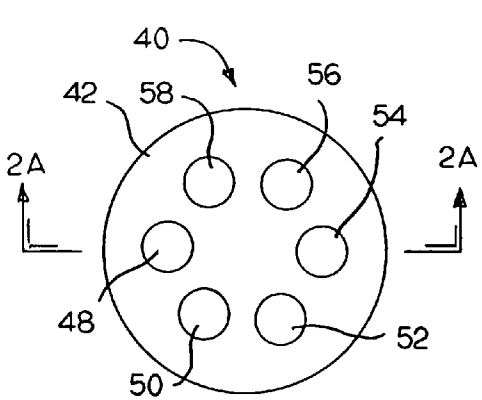
FIG. 2B is a top view of the hard composite cutting insert shown in FIG. 2A.
Figure 2A:
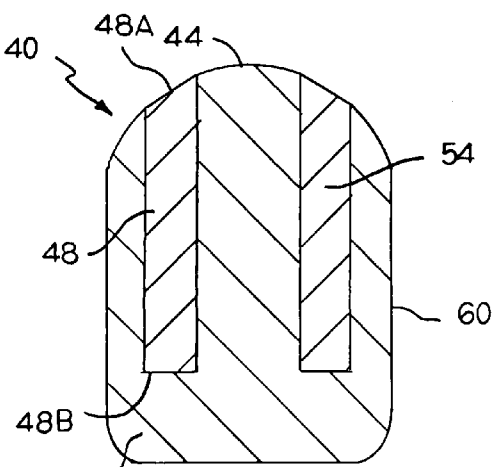
FIG. 2A is a cross-sectional view of a first specific embodiment of a hard composite cutting insert of the present invention taken along section line 2A-2A of FIG. 2B, and wherein six elongate rods are contained within the volume of the matrix of the hard composite cutting insert.

FIGS. 2A and 2B illustrate a first specific embodiment of a hard composite cutting insert that is generally designated as 40. The hard insert 40 has a peripheral surface 60. Hard composite cutting insert 40 has a body (or matrix region 42) that comprises a majority of the volume of the hard composite cutting insert 40. Further, the body 42 defines a majority of the peripheral surface 60 of the hard composite cutting insert. The body 42 can be made from any one of a variety of materials or compositions that will be described in more detail hereinafter. The body 42 has a dome-shaped top end 44 and a flat bottom end 46.

Hard composite cutting insert 40 further contains a plurality, which in this specific embodiment is six, elongate rods (48, 50, 52, 54, 56, 58). The elongate rods can be considered to be embedded regions (or hard sintered members). Referring in particular to elongate rod 48, this rod 48 has a top end 48A and a bottom end 48B. The top end 48A of elongate rod 48 is shaped do that it is flush (or even) with the contoured surface at the top end 44 of the hard composite cutting insert body 42. The bottom end 48B of elongate rod 48 is contained within the volume of the body 42. The elongate rods define a portion of the peripheral surface 60 of the hard composite cutting insert. As can be appreciated, the body 42 defines a greater amount of the peripheral surface 60 than do the elongate rods, and at the dome-shaped top end 44 of the cutting insert 40, the surface of the body 42 is larger than the combined surfaces of the exposed top ends of the elongate rods (48, 50, 52, 54, 56, 58).

Referring to FIG. 2B, the six elongate rods (48, 50, 52, 54, 56, 58) are positioned an equal distance in a radial inward direction from the peripheral surface 60 of the hard composite cutting insert body 42. Further, these six elongate rods are positioned in an equi-spaced circular configuration.

The hard composite cutting insert body 42 comprises a tougher and less hard material that the material that comprises the elongate rods. The elongate rods comprise a harder and less tough material. In other words, the material that comprises the body (or matrix region) 42 has a toughness greater than the toughness of the material that comprises the elongate rods, and the material that comprises the elongate rods (or embedded regions) has a hardness greater than the hardness of the material that comprises the body 42. The preferred composition for each component (i.e., the hard composite cutting insert body and the elongate rods) is cemented (cobalt) tungsten carbide.

In a broader aspect, the composition of the preferred cemented (cobalt) tungsten carbide has a cobalt content that ranges between about 6 weight percent and about 25 weight percent with the balance tungsten carbide. The average grain size of the tungsten carbide is equal to about 3 microns and higher with a maximum practical average grain size equal to about 10-15 microns. A more preferred composition for the material for the hard composite cutting insert body 22 comprises about 10 weight percent cobalt with the balance tungsten carbide. The tungsten carbide has an average grain size equal to 4-5 microns.

In a broader aspect, the preferred cemented (cobalt) tungsten carbide used for the elongate rods (48, 50, 52, 54, 56, 58) has a composition that has a cobalt content that ranges between about 6 weight percent and about 25 weight and the balance, except for additives, tungsten carbide. The average grain size of the tungsten carbide can range from about 1 micron to a practical maximum grain size equal to 10-15 microns. One feature of the material used for the elongate rods is that it is supposed to be harder than the material used for the body of the hard composite cutting insert. The cemented (cobalt) tungsten carbide used for elongate rods may also include additives such as, for example, vanadium, chromium and tantalum. The additives may also include titanium, niobium and/or other Group IV, V or VI metals and/or the carbides of these metals. A more preferred composition for the elongate rods comprises about 10 weight percent cobalt with the balance tungsten carbide. The tungsten carbide has an average grain size equal to about 1 micron.

It should be appreciated that under some circumstances, different elongate rods may comprise different compositions. In this regard, the specific application may dictate that the elongate rods comprise the same material or comprise two or more different materials. For example, one trio of the elongate rods (48, 50, 52) may comprises a 3 weight percent cobalt cemented tungsten carbide while the other trio of elongate rods (50, 54, 58) may comprise an 6 weight percent cemented tungsten carbide.

Figure 3B:
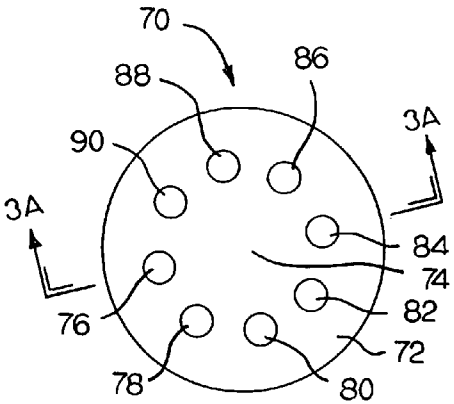
FIG. 3B is a top view of the hard composite cutting insert shown in FIG. 3A.
Figure 3A:
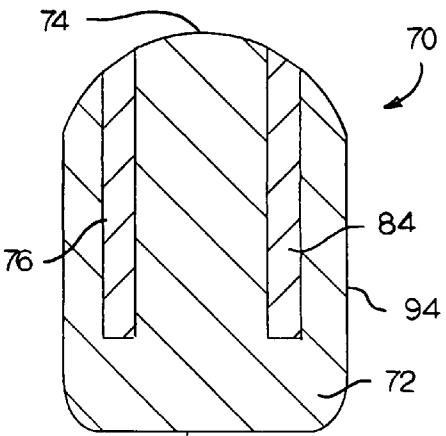
FIG. 3A is a cross-sectional view of a second specific embodiment of a hard composite cutting insert of the present invention taken along section line 3A-3A of FIG. 3B, and wherein eight elongate rods are contained within the volume of the matrix of the hard composite cutting insert.

FIGS. 3A and 3B illustrate a second specific embodiment of the hard composite cutting insert generally designated as 70. The hard composite cutting insert 70 has a hard composite cutting insert body (or matrix region) 72. The hard composite cutting insert body 72 has a dome-shaped top end 74 and a flat bottom end 75. The hard composite cutting insert 70 also has a peripheral side surface 94. The materials that are suitable for use as the body 42 are also suitable for use as the body 72.

Still referring to FIGS. 3A and 3B, there are eight elongate rods (76, 78, 80, 82, 84, 86, 88, 90). Each one of these rods (76, 78, 80, 82, 84, 86, 88, 90) has a top end and a bottom end. As can be seen in the drawings, the top end of each elongate rod has a shape that is flush with (or follows the contour) of the top end 74 of the hard composite cutting insert body 72. The materials (and the variations thereof) that are suitable for use as the elongate rods (48, 50, 52, 54, 56, 58) of the first specific embodiment are also suitable for use as these elongate rods (76, 78, 80, 82, 84, 86, 88, 90).

Figure 4B:
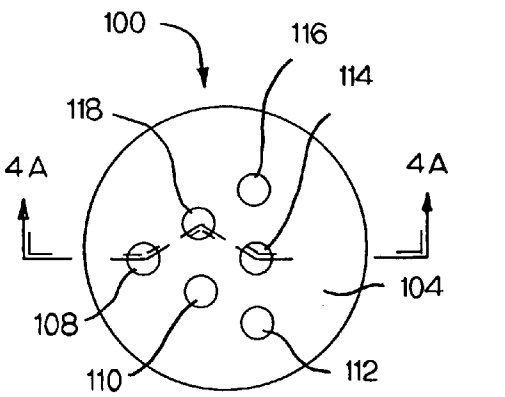
FIG. 4B is a top view of the hard composite cutting insert shown in FIG. 4A.
Figure 4A:
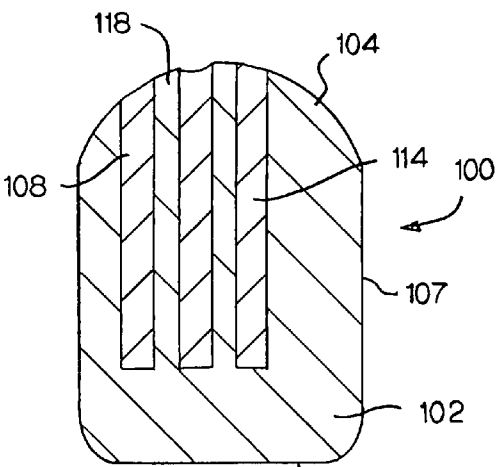
FIG. 4A is a cross-sectional view of a third specific embodiment of a hard composite cutting insert of the present invention taken along section line 4A-4A of FIG. 4B, and wherein six elongate rods are contained within the volume of the matrix of the hard composite cutting insert.

FIGS. 4A and 4B illustrate a third specific embodiment of the hard composite cutting insert generally designated as 100. The hard composite cutting insert 100 has a peripheral side surface 107. The hard composite cutting insert 100 has a hard composite cutting insert body (or matrix region) 102. The hard composite cutting insert body 102 has a top end 104 and a bottom end 106. The materials (and the variations thereof) that are suitable for use as the body 42 are also suitable for use as the body 102.

Still referring to FIGS. 4A and 4B, there are six elongate rods (108, 110, 112, 114, 116, 118). Each one of these rods (108, 110, 112, 114, 116, 118) has a top end and a bottom end. As can be seen in the drawings, the top end of each elongate rod has a shape that is flush with (or follows the contour) of the top end 74 of the hard composite cutting insert body 72. The materials that are suitable for use as the elongate rods (48, 50, 52, 54, 56, 58) of the first specific embodiment are also suitable for use as these elongate rods (108, 110, 112, 114, 116, 118).

The hard composite cutting insert body 102 defines a first portion of the peripheral surface 107 of the hard composite cutting insert. The elongate rods define a second portion of the peripheral surface of the hard composite cutting insert. The first portion of the peripheral surface defined by the body 102 is greater than the second portion of the peripheral surface defined by the elongate rods.

Figure 5B:
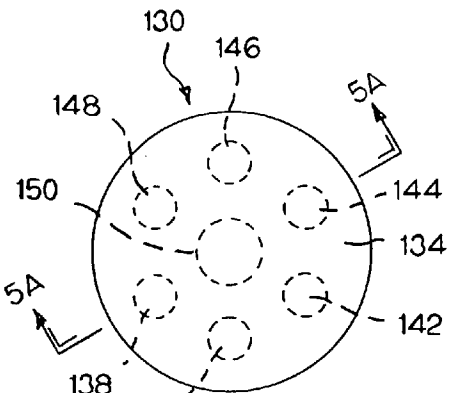
FIG. 5B is a top view of the hard composite cutting insert shown in FIG. 5A.
Figure 5A:
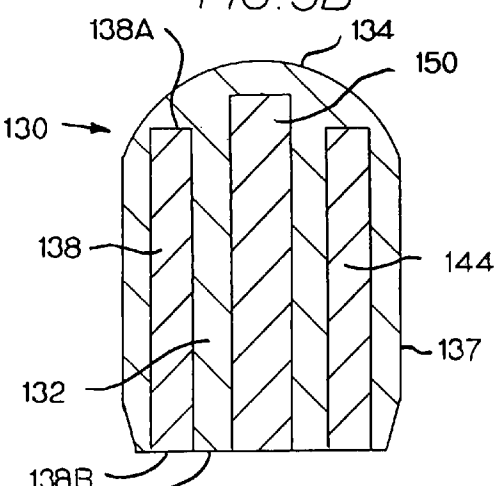
FIG. 5A is a cross-sectional view of a fourth specific embodiment of the hard composite cutting insert of the present invention taken along section line 5A-5A of FIG. 5B, and wherein seven elongate rods are contained within the volume of the matrix of the hard composite cutting insert.

FIGS. 5A and 5B illustrate a fourth specific embodiment of the hard composite cutting insert generally designated as 130. The hard composite cutting insert 130 has a hard composite cutting insert body 132. The hard composite cutting insert body 132 has a top end 134 and a bottom end 136. The hard composite cutting insert body 132 also has a peripheral side surface 137. The materials that are suitable for use as the body 42 are also suitable for use as the body 132.

Still referring to FIGS. 5A and 5B, there are seven elongate rods. These seven elongate rods include six peripheral elongate rods (138, 140, 142, 144, 146, 148) that are equi-spaced in a circular configuration. The elongate rods also include one central elongate rod 50 that is essentially located in the center of the circle defined by the peripheral rods. Each one of these rods, both the peripheral rods and the central rod, has a top end and a bottom end. In specific reference to elongate rod 138, this rod has a top end 138A and a bottom end 138B.

As can be seen in the drawings (FIGS. 5A and 5B), the bottom end (including bottom end 138B) of each elongate rod (including elongate rod 138) is flat so as to be flush with the bottom end 136 of the hard composite cutting insert body 132. The materials (and the variations thereof) that are suitable for use as the elongate rods (48, 50, 52, 54, 56, 58) of the first specific embodiment are also suitable for use as these elongate rods.

The hard composite cutting insert body 132 defines a first portion of the peripheral surface 137 of the hard composite cutting insert. The elongate rods define a second portion of the peripheral surface of the hard composite cutting insert. The first portion of the peripheral surface defined by the body 132 is greater than the second portion of the peripheral surface 137 defined by the elongate rods.

Figure 6B:
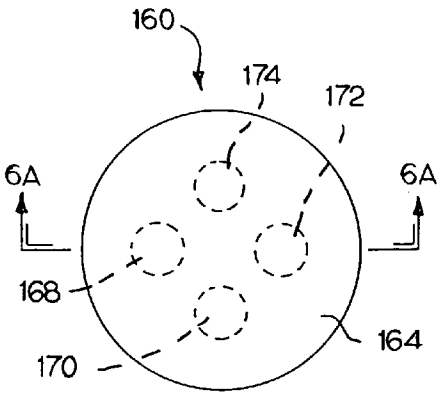
FIG. 6B is a top view of the hard composite cutting insert shown in FIG. 6A.
Figure 6A:
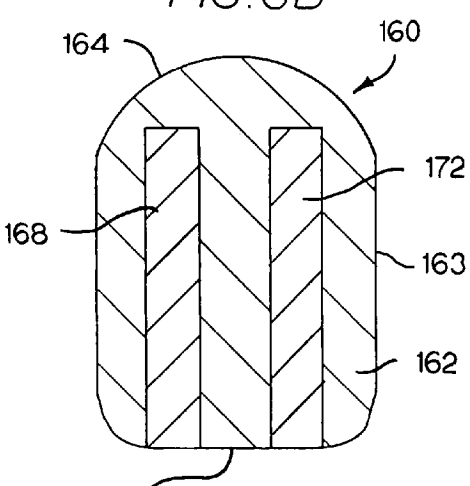
FIG. 6A is a cross-sectional view of a fifth specific embodiment of the hard composite cutting insert of the present invention taken along section line 6A-6A of FIG. 6B, and wherein four elongate rods are contained within the volume of the matrix of the hard composite cutting insert.

FIGS. 6A and 6B illustrate a fifth specific embodiment of the hard composite cutting insert generally designated as 160. The hard composite cutting insert 160 has a hard composite cutting insert body 162. The hard composite cutting insert body 162 has a top end 164 and a bottom end 166. The hard composite cutting insert body 162 also has a peripheral side surface 163. The materials (and the variations thereof) that are suitable for use as the body 42 are also suitable for use as the body 162.

Still referring to FIGS. 6A and 6B, there are four elongate rods (168, 170, 172, 174). Each one of these elongate rods (168, 170, 172, 174) has a top end and a bottom end. As can be seen in the drawings, the bottom end of each elongate rod is flush with the bottom end 166 of the hard composite cutting insert body 162. The materials (and the variations thereof) that are suitable for use as the elongate rods (48, 50, 52, 54, 56, 58) of the first specific embodiment are also suitable for use as these elongate rods (168, 170, 172, 174).

The hard composite cutting insert body 162 defines a first portion of the peripheral surface 163 of the hard composite cutting insert. The elongate rods define a second portion of the peripheral surface of the hard composite cutting insert. The first portion of the peripheral surface defined by the body 162 is greater than the second portion of the peripheral surface 163 defined by the elongate rods.

Figure 7B:
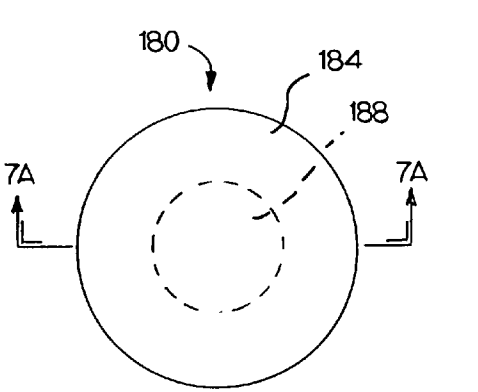
FIG. 7B is a top view of the hard composite cutting insert shown in FIG. 7A.
Figure 7A:
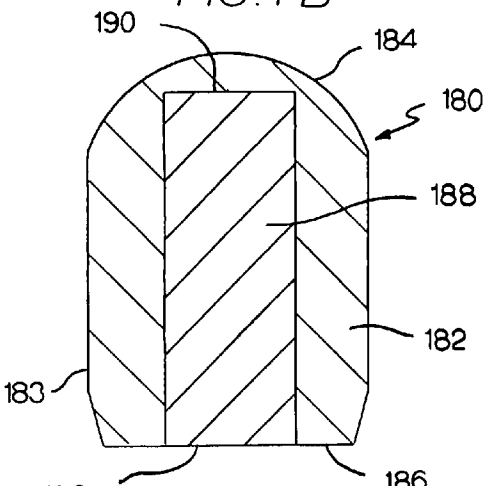
FIG. 7A is a cross-sectional view of a sixth specific embodiment of the hard composite cutting insert of the present invention taken along section line 7A-7A of FIG. 7B, and wherein a single elongate rod is contained within the volume of the matrix of the hard composite cutting insert.

FIGS. 7A and 7B illustrate a sixth specific embodiment of the hard composite cutting insert generally designated as 180. The hard composite cutting insert 180 has a hard composite cutting insert body 182. The hard composite cutting insert body 182 has a top end 184 and a bottom end 186. The hard composite cutting insert body 182 also has a peripheral side surface 183. The materials that are suitable for use as the body 42 are also suitable for use as the body 182.

Still referring to FIGS. 7A and 7B, the hard composite cutting insert 180 contains a single elongate rod 188. Rod 188 has a top end 190 and a bottom end 192. The elongate rod 188 is flush with the bottom end 186 of the hard composite cutting insert body 182. The materials that are suitable for use as the elongate rods (48, 50, 52, 54, 56, 58) of the first specific embodiment are also suitable for use as the elongate rod 188.

In FIG. 7A, the top end 190 of the rod 188 is illustrated as flat. However, applicants contemplate that the top end may also present other geometries such as, for example, a geometry that corresponds to the contour of the top end 184 of the hard composite cutting insert 180.

The hard composite cutting insert body 182 defines a first portion of the peripheral surface 183 of the hard composite cutting insert. The elongate rods define a second portion of the peripheral surface of the hard composite cutting insert. The first portion of the peripheral surface defined by the body is greater than the second portion of the peripheral surface defined by the elongate rods.

Figures 8A, 8B, 9, 10:
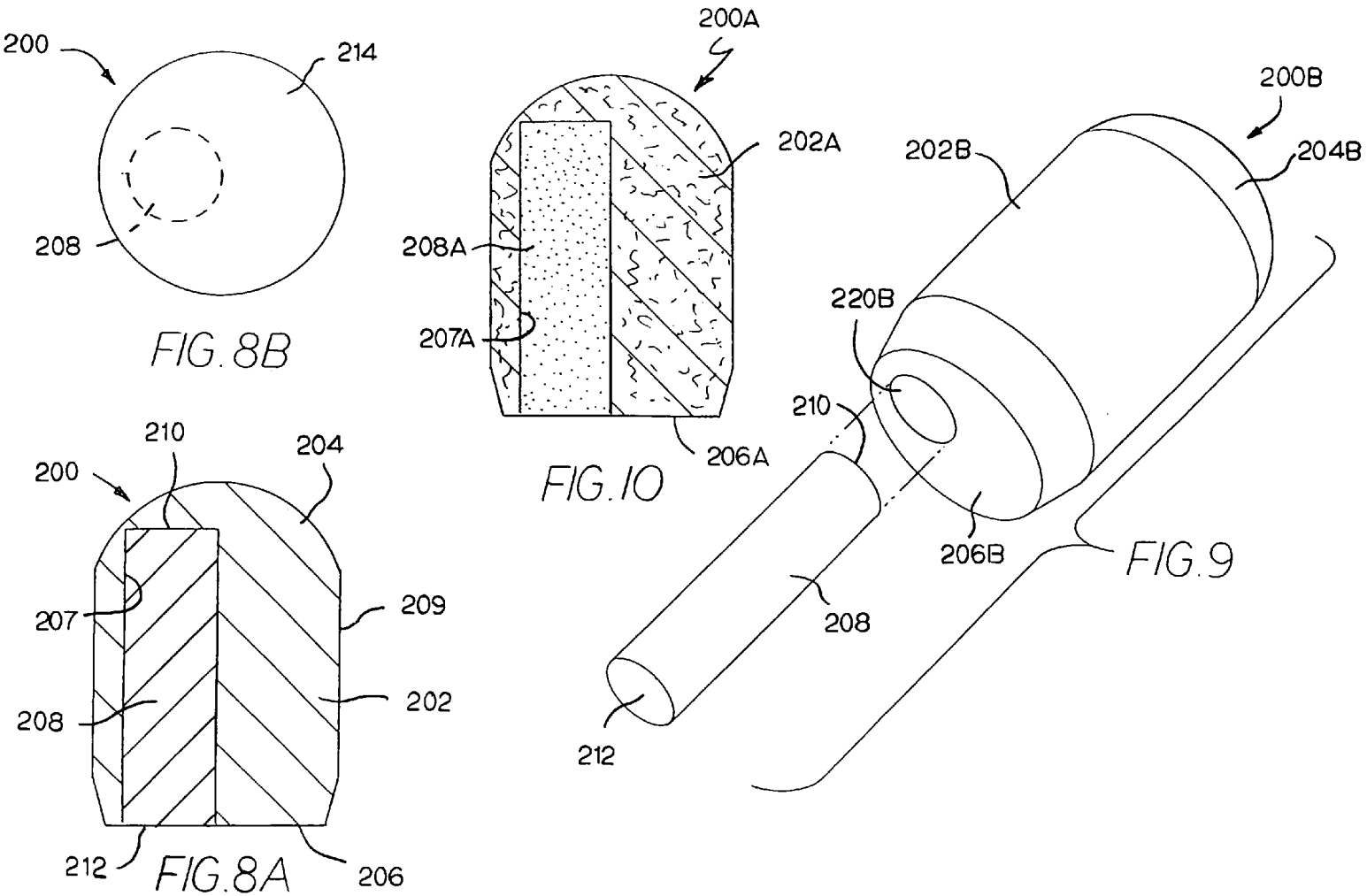
FIG. 8A is a cross-sectional view of a seventh specific embodiment of the hard composite cutting insert of the present invention taken along section line 8A-8A, and wherein a single elongate rod is contained within the volume of the matrix of the hard composite cutting insert.
FIG. 8B is a top view of the hard composite cutting insert of FIG. 8A.
FIG. 9 is an isometric view of the hard composite cutting insert of FIGS. 8A and 8B wherein the elongate rod is illustrated as exploded away from the matrix of the hard composite cutting insert.
FIG. 10 is a cross-sectional of a hard composite cutting insert like that shown in FIG. 8A, except that the matrix is in powder form and the constituents that form the elongate rod are in powder form.

FIGS. 8A and 8B illustrate a seventh specific embodiment of the hard composite cutting insert generally designated as 200. The hard composite cutting insert 200 has a hard composite cutting insert body 202. The hard composite cutting insert body 202 has a top end 204 and a bottom end 206. The hard composite cutting insert body 202 also has a peripheral side surface 207. The materials that are suitable for use as the body 42 are also suitable for use as the body 202.

Still referring to FIGS. 8A and 8B, the hard composite cutting insert 200 contains one elongate rod 208. As can be seen, elongate rod 208 is not positioned coaxial with the central longitudinal axis of the hard body 202, but is positioned to one side of the central longitudinal axis. Rod 208 has a top end 210 and a bottom end 212. As can be seen in the drawings, the bottom end 212 of the elongate rod 208 is flush with the bottom end 206 of the hard composite cutting insert body 202. The materials that are suitable for use as the elongate rods (48, 50, 52, 54, 56, 58) are also suitable for use as this elongate rod 208.

The hard composite cutting insert body 202 defines a first portion of the peripheral surface 207 of the hard composite cutting insert. The elongate rods define a second portion of the peripheral surface of the hard composite cutting insert. The first portion of the peripheral surface defined by the body is greater than the second portion of the peripheral surface defined by the elongate rods.

There are two basic methods to make the hard composite cutting inserts as disclosed herein. As will be described in more detail hereinafter, the first method uses a sintered elongate rod positioned in a bore in a body. This composite (i.e., sintered elongate rod-body) is then sintered to form the hard composite cutting insert. The second method uses a body that contains a bore of cavity filled with a powder mixture. This composite (powder mixture-body) is sintered to form the hard composite cutting insert.

It should be appreciated that the body that contains either the sintered elongate rod or the powder mixture can be either a green compact or a presintered body. The green compact is a green as-pressed powder body that has not been heated. The presintered body is a green pressed compact that has been heated at a temperature between about 800 degrees Centigrade and about 1000 degrees Centigrade for a selected duration. While the presintered body is not a fully sintered body, it is harder than the green compact. The presintered body can be machined. The presintered body is less susceptible than the green compact to chipping or cracking upon the formation (e.g., by drilling or he like) of the hole or bore on the body. Thus, it should be appreciated that the following description of the method encompasses a body that can be either a green compact or a presintered body.

FIG. 9 is discloses the first method to make the specific embodiment of the hard composite cutting insert 200 as illustrated in FIGS. 8A and 8B. In this regard, a sintered elongate rod 208 is positioned within a bore 220B or cavity in a body 202B. As described above, the body may be either a green compact or a presintered body. The bore 220B opens at the bottom end 206B of the body 202B.

During sintering, the composite part 200B, i.e., the body 202B-elongate rod 208 composite, is subjected to sintering temperatures. At these temperatures, the body shrinks in volume a sufficient amount (e.g., about twenty linear percent, i.e., about 50 volume percent) so as to compress against the peripheral surface of the elongate rod 208 thereby bringing the elongate rod into intimate contact with the hard composite cutting insert body 202. The parts (i.e., the body 202B and the elongate rod 208) are fused together during sintering. This compression retains the elongate rod 208 in the hard composite cutting insert body 202. Further, the body fuses about the elongate rod in such a fashion so that the hard composite cutting insert body does not contain any distortions or cracking. It should be appreciated that this method is applicable to each one of the specific embodiments disclosed herein.

FIG. 10 discloses the second method. Referring to FIG. 10, there is illustrated a body 202A that contains a bore 207A therein. As described above, the body may be either a green compact or a presintered body. Bore 207A opens at the bottom end 206A of the body 206A. Bore 207A is filled with a powder mixture to form a powder mass 208A. When the powder mixture 208A is sintered to full density, it will form the elongate rod.

During sintering of the body 202A filled with the powder mixture, there is shrinkage of the body, as well as sintering to full density of the powder mixture. The extent of the shrinkage in volume of the body 202A (e.g., about 45 percent in volume to about 55 percent in volume) is sufficient to cause the hard inset body 202 to compress against the elongate rod 208 causing intimate contact and fusing together during sintering thereby securely retaining the elongate rod 208 in the bore 207. Due to the nature of the shrinkage, the hard composite cutting insert body does not contain any distortions or cracking. It should be appreciated that this method is applicable to each one of the specific embodiments disclosed herein.

Figure 11B:
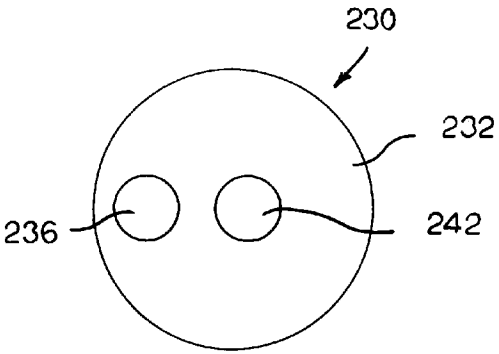
FIG. 11B is atop view of the hard composite cutting insert of FIG. 11A.
Figure 11A:
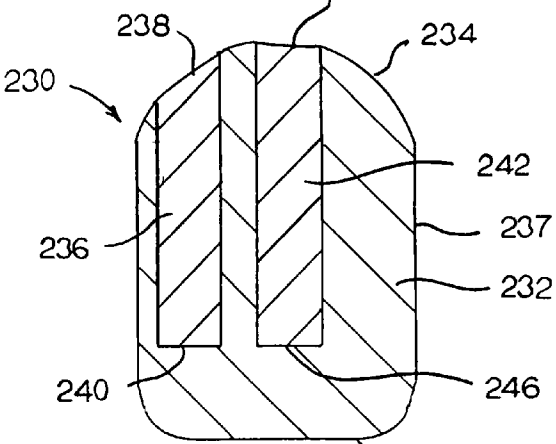
FIG. 11A is a cross-sectional view of an eighth specific embodiment of the hard composite cutting insert of the present invention taken along section line 11A-11A, and wherein two elongate rods are contained within the volume of the matrix of the hard composite cutting insert.

FIGS. 11A and 11B illustrate an eighth specific embodiment of the hard composite cutting insert generally designated as 230. The hard composite cutting insert 230 has a hard composite cutting insert body 232. The hard composite cutting insert body 232 has a top end 234 and a bottom end 236. The hard composite cutting insert body 232 also has a peripheral side surface 237. The materials that are suitable for use as the body 42 are also suitable for use as the body 232.

Still referring to FIGS. 11A and 11B, there are two elongate rods 236 and 242. Each one of these rods 236, 242 has a top end (238, 244) and a bottom end (240, 246). As can be seen in the drawings, the top end of each elongate rod is shaped so as to be flush (or follow the contour) of the top end of the hard composite cutting insert body. The materials (and the variations thereof) that are suitable for use as the elongate rods (48, 50, 52, 54, 56, 58) of the first specific embodiment are also suitable for use as these elongate rods 236, 242.

The hard composite cutting insert body 232 defines a first portion of the peripheral surface 237 of the hard composite cutting insert. The elongate rods define a second portion of the peripheral surface of the hard composite cutting insert. The first portion of the peripheral surface defined by the body is greater than the second portion of the peripheral surface defined by the elongate rods.

Figure 12:
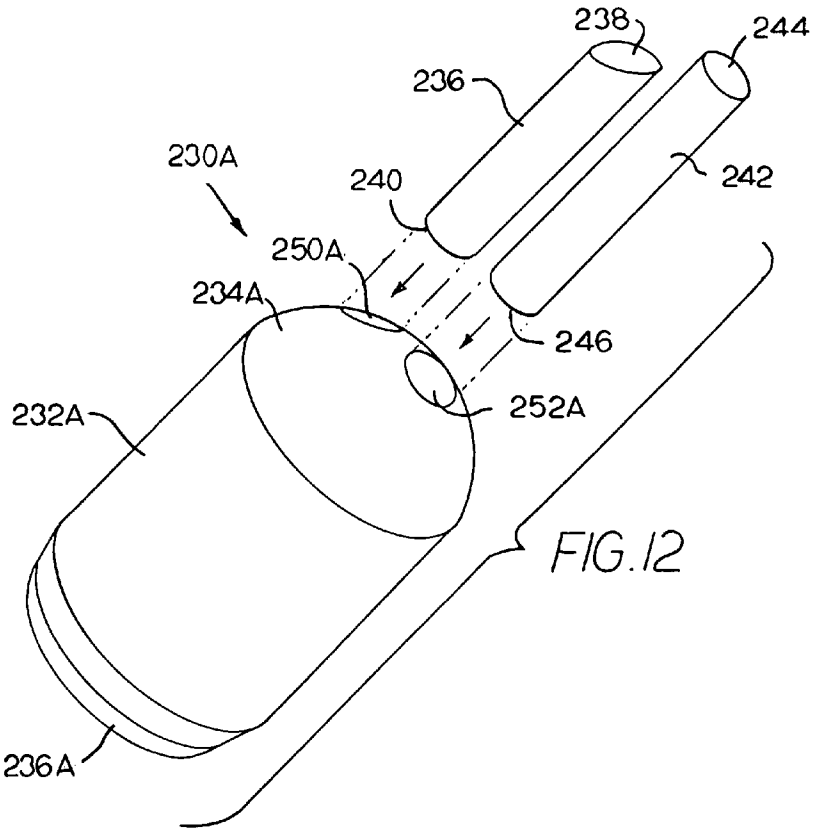
FIG. 12 is an isometric view of the hard composite cutting insert illustrated in FIGS. 11A and 11B with the elongate rods exploded from the matrix of the hard composite cutting insert.

The hard composite cutting insert 230 can be made using a method along the lines of the method disclosed in conjunction with FIG. 9. In this regard, FIG. 12 discloses such a method in which the elongate rods 236 and 242 are positioned in a body 232A. More specifically, the elongate rods 236, 242, which have already been sintered, are inserted into bores 250A and 252A formed in the body 232A. The bores 250A, 252A open at the bottom end 236A of the body 232A.

During sintering, the composite part of the body and the elongate rods are subjected to sintering temperatures. At these temperatures, the body shrinks in volume (e.g., about 45 volume percent to about 55 volume percent). Further, the elongate rods and the body actually fuse together creating a monolithic hard composite cutting insert body. Because of the fact that the elongate rods and the body fuse together, the hard composite cutting insert body does not contain any distortions or cracking. It should be appreciated that this method is applicable to each one of the specific embodiments disclosed herein.

Each one of the hard composite cutting inserts as illustrated in the drawings present a generally dome-shaped geometry at the axial forward end thereof. However, applicants contemplate that the hard composite cutting inserts could exhibit any one of a number of different geometries. For example, these geometries could include conical shapes or spherical shapes or chisel shapes.

Figure 13:
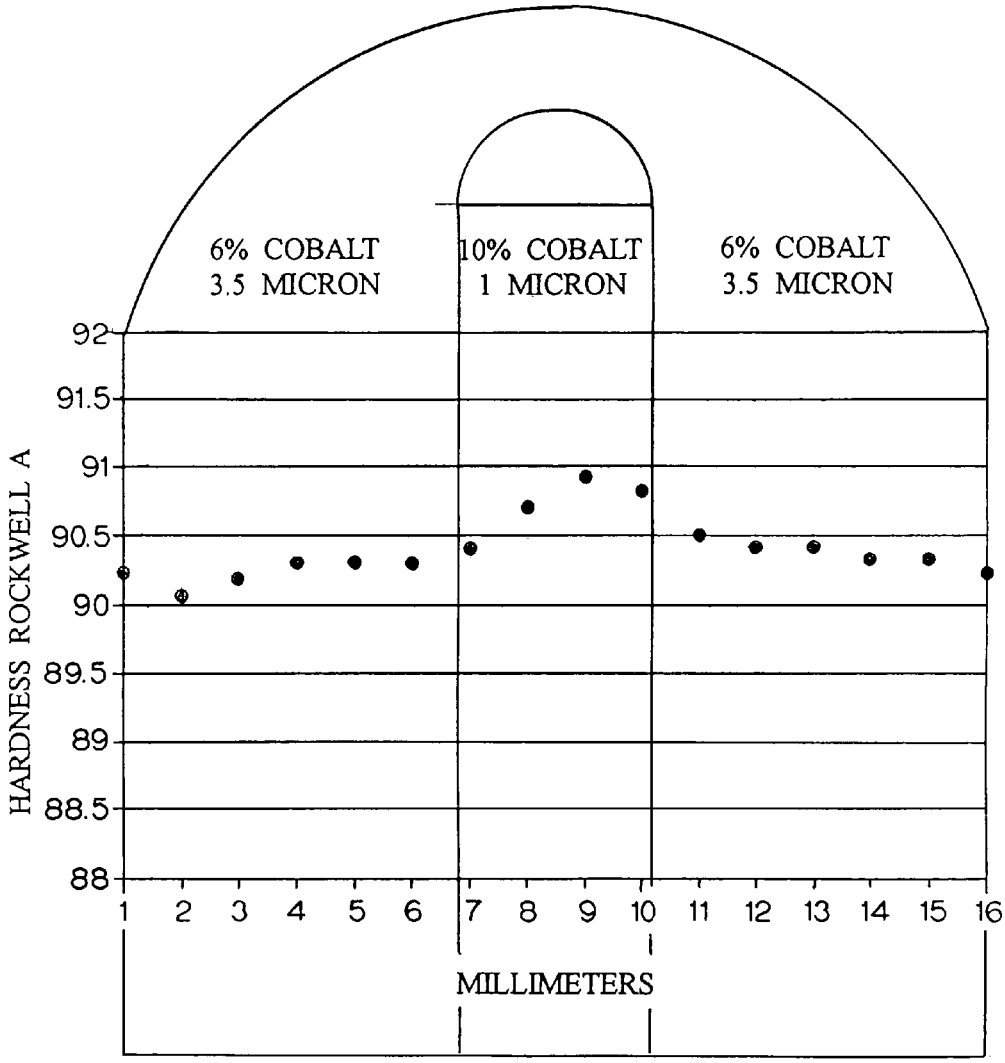
FIG. 13 is a hardness profile across the transverse dimension of a specific Example A (6 weight percent cobalt-coarser grain tungsten carbide body with a 10 weight percent cobalt-finer grain tungsten carbide insert) of the hard composite cutting insert and where the hardness profile is illustrated against a background of the profile of the hard insert with the vertical axis representing the hardness (Rockwell A) and the horizontal axis representing the transverse dimension set forth in millimeters.

FIG. 13 illustrates the hardness profile of a specific embodiment of a hard composite cutting insert, i.e., Example A. The vertical axis presents the hardness as measured in Rockwell A via the following test method: ASTM B294-92 (2001) for a Standard Test Method for Hardness Testing of Cemented Carbides on a Wilson Series B2000 hardness tester. The horizontal axis is the distance of the transverse dimension of the hard composite cutting insert as it travels from one side to the other side thereof.

Example A presented a geometry generally along the lines of the geometry of the hard composite cutting insert shown in FIG. 7. Example A comprised a body of the following composition wherein the body is a green/presintered body: about 6 weight percent cobalt and about 94 weight percent tungsten carbide that had an average grain size equal to 3.5 microns. The insert is an elongate rod that had the following composition: about 10 weight percent cobalt and about 90 weight percent tungsten carbide that had an average grain size equal to 1 microns. In regard to the processing, the sintered core (elongate rod) was placed in the cavity formed in the presintered body, and then the combination was subjected to sinter HIPing for 5 to 90 minutes at 1380 to 1450 degrees Centigrade at 300 to 800 pounds per square inch (psi) argon pressure. The processing parameters for the components of Example A were as follows: the core was sinterhipped for 5 to 90 minutes at 1380 to 1450 degrees Centigrade under a pressure of 300 to 800 psi argon gas, and the body was presintered for 5 to 90 minutes at 700 to 900 degrees Centigrade in vacuum.

Looking at the profile of FIG. 13, one sees that for about the first 6 millimeters in from the left side and for about the first 6 millimeters in from the right side (as shown in FIG. 13), the hardness of the hard composite cutting inserts remains between about 90.00 Rockwell A and about 90.50 Rockwell A. For a thickness of about 3.5-4 millimeters in the interior region of the hard composite cutting insert, the hardness is equal to between about 90.40 Rockwell A and about 91.00 Rockwell A. The region of greater hardness corresponds to the location of the elongate rod. One should note that the higher hardness is near the center of the interior region.

Figure 14:
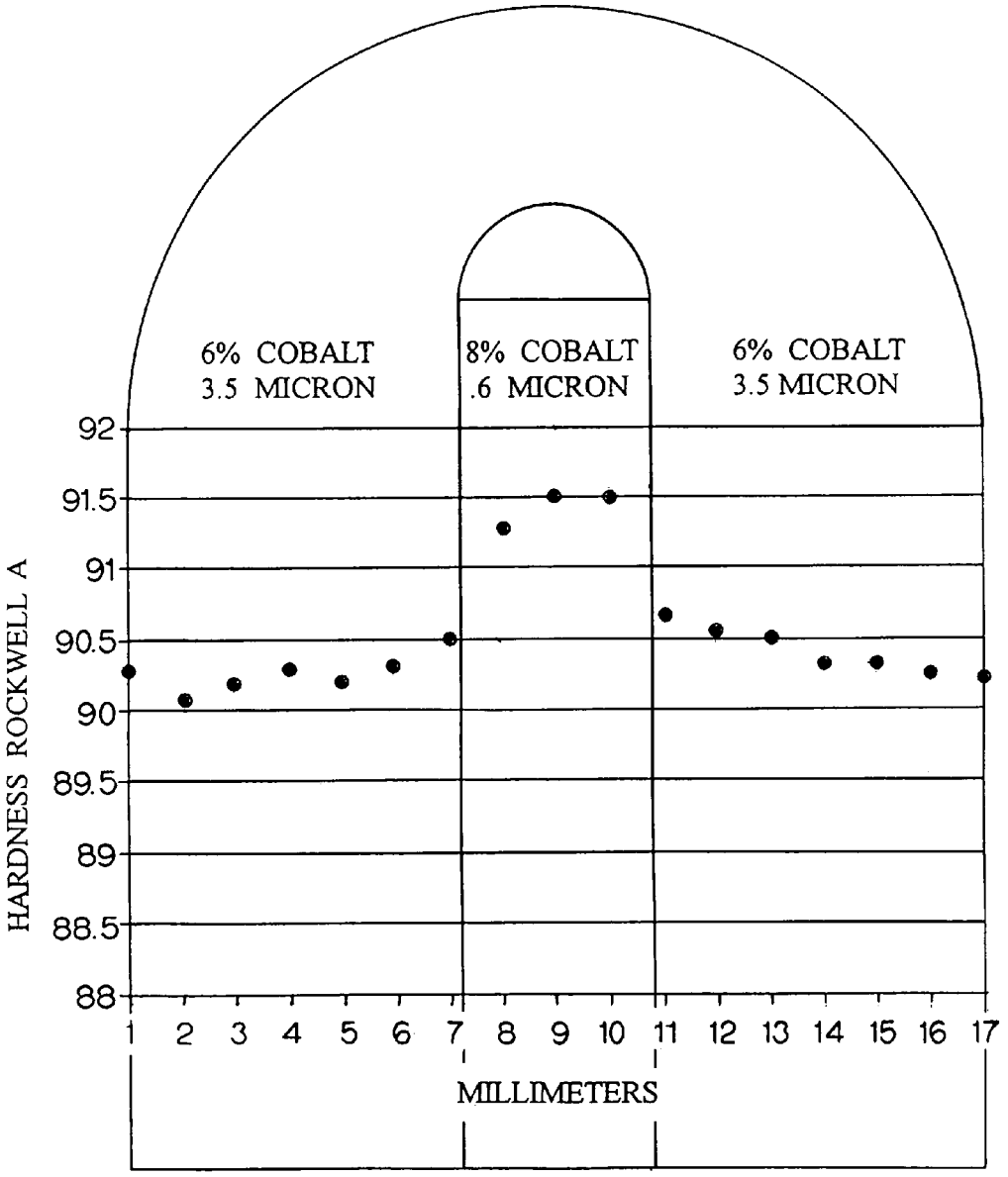

FIG. 14 illustrates the hardness profile of a specific embodiment of a hard composite cutting insert, i.e., Example B. The vertical axis presents the hardness as measured in Rockwell A via ASTM B294-92 (2001) for a Standard Test Method for Hardness Testing of Cemented Carbides on a Wilson Series B2000 hardness tester. The horizontal axis is the distance of the transverse dimension of the hard composite cutting insert as it travels from one side to the other side thereof.

Example B presented a geometry generally along the lines of the geometry of the hard composite cutting insert shown in FIG. 7. Example B comprised a body of the following composition wherein the body is a green/presintered body: about 6 weight percent cobalt and about 94 weight percent tungsten carbide that had an average grain size equal to 3.5 microns. The insert is an elongate rod that had the following composition: about 8 weight percent cobalt and about 92 weight percent tungsten carbide that had an average grain size equal to 0.6 microns. In regard to the processing, the sintered core (elongate rod) was placed in the cavity formed in the presintered body, and then the combination was subjected to sinter HIPing for 5 to 90 minutes at 1380 to 1450 degrees Centigrade at 300 to 800 pounds per square inch (psi) argon pressure. The processing parameters for the components of Example B were as follows: the core was sinterhipped for 5 to 90 minutes at 1380 to 1450 degrees Centigrade under a pressure of 300 to 800 psi argon gas, and the body was presintered for 5 to 90 minutes at 700 to 900 degrees Centigrade in vacuum.

Figure 15:
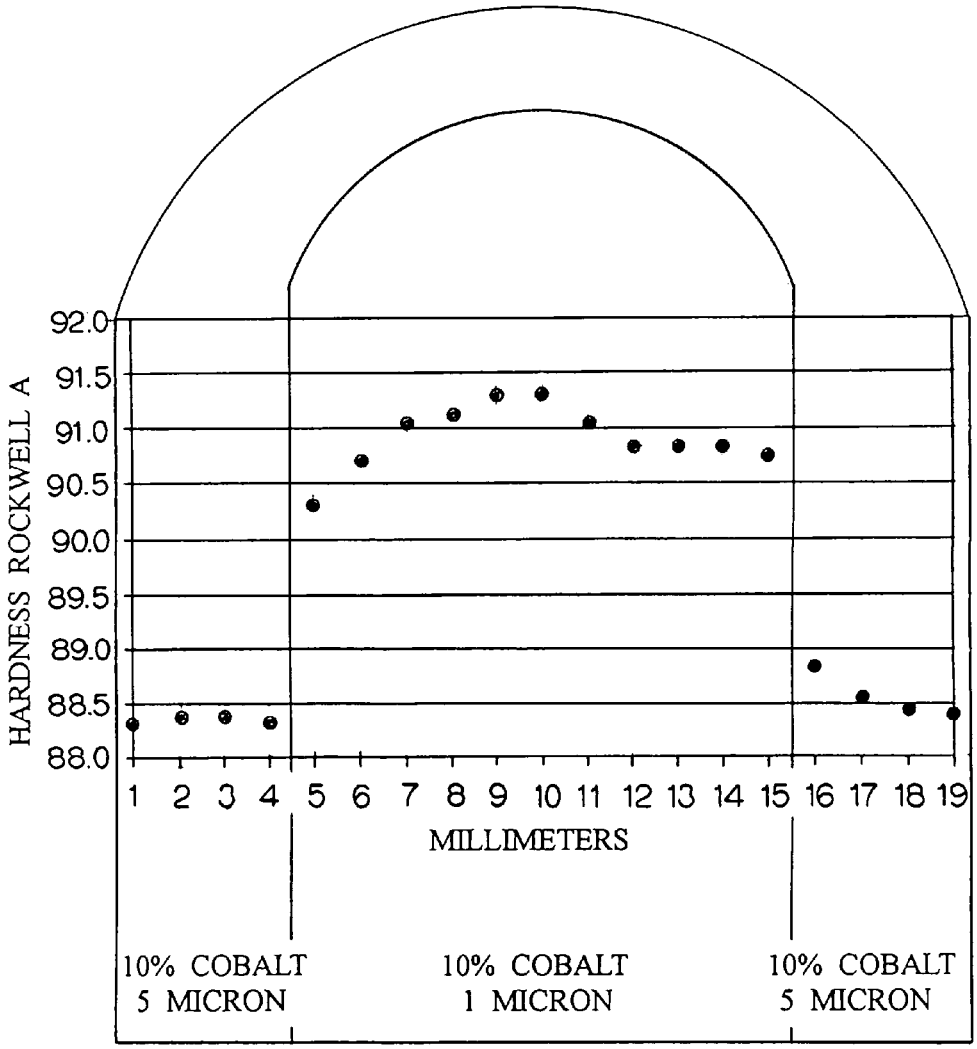
FIG. 15 is a hardness profile across the transverse dimension of a specific Example C (10 weight percent cobalt-medium grain tungsten carbide body with a 10 weight percent cobalt-finer grain tungsten carbide insert) of the hard composite cutting insert and where the hardness profile is illustrated against a background of the profile of the hard insert with the vertical axis representing the hardness (Rockwell A) and the horizontal axis representing the transverse dimension set forth in millimeters.

Looking at the profile of FIG. 14, one sees that for about the first 6-7 millimeters in from the left side and for about the first 4 millimeters in from the right side (as shown in FIG. 14), the hardness of the hard composite cutting inserts remains between about 90.00 Rockwell A and about 90.50 Rockwell A. For a thickness of about 4 millimeters in the interior of the hard composite cutting insert, the hardness is equal to between about 91.00 Rockwell A and about 91.50 Rockwell A. The region of greater hardness corresponds to the location of the elongate rod. One should note that the higher hardness is near the center of the interior region. a FIG. 15 is a hardness profile of a specific hard composite cutting insert, i.e., Example C. The vertical axis represents the hardness as measured in Rockwell A via the following test method: ASTM B294-92 (2001) for a Standard Test Method for Hardness Testing of Cemented Carbides on a Wilson Series B2000 hardness tester. The horizontal axis is the distance of the transverse dimension of the hard composite cutting insert as it travels from one side to the other side. Example C presented a geometry generally along the lines of the geometry of the hard composite cutting insert shown in FIG. 7. Example C comprised a body of the following composition wherein the body is a green/presintered body: about 10 weight percent cobalt and about 90 weight percent tungsten carbide that had an average grain size equal to 5 microns. The insert is an elongate rod that had the following composition: about 10 weight percent cobalt and about 90 weight percent tungsten carbide that had an average grain size equal to 1 microns. In regard to the processing, the sintered core (elongate rod) was placed in the cavity formed in the presintered body, and then the combination was subjected to sinter HIPing for 5 to 90 minutes at 1380 to 1450 degrees Centigrade at 300 to 800 pounds per square inch (psi) argon pressure. The processing parameters for the components of Example C were as follows: the core was sinterhipped for 5 to 90 minutes at 1380 to 1450 degrees Centigrade under a pressure of 300 to 800 psi argon gas, and the body was presintered for 5 to 90 minutes at 700 to 900 degrees Centigrade in vacuum.

Looking at the hardness profile of FIG. 15, one sees that for the first 3.5 millimeters in from the left side, the hardness remains within the range equal to between about 88.0 Rockwell A and about 88.5 Rockwell A. For the first 3.5 millimeters in from the right side, the hardness remains between about 88.4 Rockwell A and about 89.0 Rockwell A. For a thickness equal to about 11 millimeters in the interior region of the hard composite cutting insert, the hardness remains in the range of between about 90.3 Rockwell A and about 91.5 Rockwell A. It should be noted that the hardness appears to be at a maximum (about 91.4 Rockwell A) in the central portion of the interior region of the hard composite cutting insert.

It thus becomes apparent that the applicants have provided an improved hard composite cutting insert used in conjunction with a bit body for the purpose of impinging the earth strata wherein various geometric configurations of different grades of material can be employed by the hard composite cutting insert. It is also apparent that the applicants have provided an improved hard composite cutting insert used in conjunction with a bit body for the purpose of impinging the earth strata wherein different regions of different grades of material can be selectively positioned or located in the hard composite cutting insert.

The patents and other documents identified herein are hereby incorporated by reference herein.

Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed:

1. A hard composite cutting insert having a top end and a bottom end and a peripheral surface, the hard composite cutting insert comprising:

a matrix region, and a portion of the matrix region defining a first section of the peripheral surface;

the matrix region containing an embedded member wherein a portion of the embedded member defining a second section of the peripheral surface, and the first section of the peripheral surface is larger than the second section of the peripheral surface at the top end of the insert; and the matrix region being made from a first composition and the embedded member being made from a second composition wherein the first composition having a toughness greater than the toughness of the second composition and the second composition having a hardness greater than the hardness of the first composition and:

(a) wherein the matrix region comprises between about 6 weight percent and about 25 weight percent cobalt and between about 75 weight percent and about 94 weight percent tungsten carbide; and the average grain size of the tungsten carbide ranging between about 3 microns and about 15 microns; and (b) wherein the embedded member comprises between about 6 weight percent and about 25 weight percent cobalt and between about 75 weight percent and about 94 weight percent tungsten carbide; and the average grain size of the tungsten carbide ranging between about 1 micron and about 15 microns.

2. The hard composite cutting insert of claim 1 wherein the matrix region comprises between about 7 weight percent and about 13 weight percent cobalt and between about 87 weight percent and about 93 weight percent tungsten carbide wherein the average grain size of the tungsten carbide ranges between about 4 microns and about 5 microns.

3. The hard composite cutting insert of claim 1 wherein the embedded member comprises between about 7 weight percent and about 13 weight percent cobalt and between about 87 weight percent and about 93 weight percent tungsten carbide wherein the average grain size of the tungsten carbide is equal to about 1 micron.

4. The hard composite cutting insert of claim 1 wherein the matrix region further includes one or more of Group IVA, VA and VIA metals and the carbides thereof, and the embedded member further includes one or more of Group IVA, VA and VIA metals and the carbides thereof.

5. A hard composite cutting insert for use in conjunction with a drill bit the hard composite cutting insert comprising:

a cutting insert body having a top end and a bottom end, a hard member having a top end and a bottom end, and the hard member being contained within the cutting insert body so that bottom end of the hard member is exposed at the bottom end of the cutting insert body and the top end of the hard member is not exposed at the top end of the cutting insert body; and the cutting insert body being made from a first composition and the hard member being made from a second composition wherein the first composition having a toughness greater than the toughness of the second composition and the second composition having a hardness greater than the hardness of the first composition.

6. The hard composite cutting insert of claim 5 wherein the cutting insert body comprises cobalt and tungsten carbide, and the hard member comprises cobalt and tungsten carbide and (a) wherein said cutting insert body comprises between about 6 weight percent and about 25 weight percent cobalt and between about 75 weight percent and about 94 weight percent tungsten carbide; and the average grain size of the tungsten carbide ranging between about 3 microns and about 15 microns; and (b) wherein said hard member comprises between about 6 weight percent and about 25 weight percent cobalt and between about 75 weight percent and about 94 weight percent tungsten carbide; and the average grain size of the tungsten carbide ranging between about 1 micron and about 15 microns.

7. The hard composite cutting insert of claim 6 wherein the cutting insert body comprises between about 7 weight percent and about 13 weight percent cobalt and between about 87 weight percent and about 93 weight percent tungsten carbide wherein the average grain size of the tungsten carbide ranges between about 4 microns and about 5 microns.

8. The hard composite cutting insert of claim 6 wherein the hard member comprises between about 7 weight percent and about 13 weight percent cobalt and between about 87 weight percent and about 93 weight percent tungsten carbide wherein the average grain size of the tungsten carbide is equal to about 1 micron.

9. The hard composite cutting insert of claim 6 wherein the cutting insert body further includes one or more of Group IVA, VA and VIA metals and the carbides thereof, and the embedded region further includes one or more of Group IVA, VA and VIA metals and the carbides thereof.

10. A method for making a hard composite cutting insert comprising the steps of:

providing a matrix body containing a cavity therein, and the cavity having an opening thereto, and the matrix body being made from a first composition comprising between about 6 weight percent and about 25 weight percent cobalt and between about 75 weight percent and about 94 weight percent tungsten carbide and the average grain size of the tungsten carbide ranging between about 3 microns and about 15 microns;

positioning a sintered hard member in the cavity to form a composite, and the sintered hard member being made from a second composition comprising between about 6 weight percent and about 25 weight percent cobalt and between about 75 weight percent and about 94 weight percent tungsten carbide; and the average grain size of the tungsten carbide ranging between about 1 micron and about 15 microns, wherein the first composition having a toughness greater than the toughness of the second composition and the second composition having a hardness greater than the hardness of the first composition; and sintering the composite to form the hard composite cutting insert.

11. The method of claim 10 wherein the matrix body further includes one or more of Group IVA, VA and VIA metals and the carbides thereof, and the sintered hard member further includes one or more of Group IVA, VA and VIA metals and the carbides thereof.

12. The method of claim 10 wherein the matrix body is a presintered body.

13. The method of claim 10 wherein the matrix body is a green compact.

14. A method for making a hard composite cutting insert comprising the steps of:

providing a body containing a cavity therein, and the cavity having an opening thereto, and the body being made from a first composition;

positioning a powder mixture of tungsten carbide and cobalt in the cavity to form a composite, and the powder mixture being of a second composition wherein the first composition having a toughness greater than the toughness of the second composition and the second composition having a hardness greater than the hardness of the first composition; and sintering the composite to form the hard composite cutting insert.

15. The method of claim 14 wherein the body comprises between about 6 weight percent and about 25 weight percent cobalt and between about 75 weight percent and about 94 weight percent tungsten carbide; and the average grain size of the tungsten carbide ranging between about 3 microns and about 15 microns; and the sintered hard member comprises between about 6 weight percent and about 25 weight percent cobalt and between about 75 weight percent and about 94 weight percent tungsten carbide; and the average grain size of the tungsten carbide ranging between about 1 micron and about 15 microns.

16. The method of claim 14 wherein the body further includes one or more of Group IVA, VA and VIA metals and the carbides thereof, and the sintered hard member further includes one or more of Group IVA, VA and VIA metals and the carbides thereof.

* * * * *